United States Patent [19]

Buske

[11] 3,933,268

[45] Jan. 20, 1976

[54] CONTAINER

[76] Inventor: Fritz Buske, Rothenbaumchaussee 131, 2 Hamburg 13, Germany

[22] Filed: Jan. 11, 1974

[21] Appl. No.: 432,558

[30] Foreign Application Priority Data

| | | |
|---|---|---|
| Jan. 13, 1973 | Germany | 2301645 |
| Dec. 29, 1973 | Germany | 2365193 |
| May 24, 1973 | Germany | 2326931 |

[52] U.S. Cl. ..... 220/23.4; 206/504; 215/10

[51] Int. Cl.[2] ..... B65D 21/02

[58] Field of Search..... 220/23.4, 23.6, 23.83, 220/23.86, 4 B, 4 E; 206/499, 504; 229/22, DIG. 11; 215/10

[56] References Cited

UNITED STATES PATENTS

| | | | |
|---|---|---|---|
| 353,600 | 11/1886 | Sloan | 215/10 |
| 888,611 | 5/1908 | Heinze | 220/23.4 |
| 2,111,884 | 3/1938 | Cahaney | 206/499 |
| 2,256,024 | 9/1941 | Hill | 229/DIG. 11 |
| 2,670,892 | 3/1954 | Kendrick | 229/22 |
| 3,145,870 | 8/1964 | Lockwood | 220/4 E |
| 3,341,053 | 9/1967 | Keene | 220/23.4 |
| 3,343,670 | 9/1967 | Stephan | 206/432 |
| 3,353,665 | 11/1967 | Iwanski | 206/499 |
| 3,369,658 | 2/1968 | Hasselmann | 220/23.4 |
| 3,419,176 | 12/1968 | Lipfert | 220/23.4 |

FOREIGN PATENTS OR APPLICATIONS

| | | | |
|---|---|---|---|
| 411,686 | 11/1966 | Switzerland | 220/23.6 |
| 790,060 | 11/1935 | France | 220/23.4 |
| 411,694 | 11/1966 | Switzerland | 220/4 E |
| 107,495 | 1/1964 | Netherlands | 220/23.6 |

*Primary Examiner*—George E. Lowrance
*Attorney, Agent, or Firm*—Beaman & Beaman

[57] ABSTRACT

A container for packaging liquids, in particular mineral oil and the like and other media such as powders, pastes and the like, said container having the form of a preferably right prism with two polygonal bases and being adapted to be placed with at least one of its basal and lateral faces against corresponding faces of similarly formed containers to form a group of containers, at least one of said basal and lateral faces being provided with means for engaging a corresponding face of a similar container when placed against said corresponding face to counteract slipping between the engaging faces.

6 Claims, 11 Drawing Figures

CONTAINER

BACKGROUND OF THE INVENTION

The present invention relates to a container for packaging liquids, in particular mineral oil and the like, and other media such as powders, pastes and the like.

Such media are packed and sold in large quantities in circular cylindrical or oval containers of glass or plastic or an impregnated plastic/paperboard combination. In particular, mineral oil for retail sale is always sold in circular cylindrical cans made of sheet metal or circular cylindrical containers made of a combination of plastic and sheet metal or coated paperboard and sheet metal. The cylindrical form of the known containers is disadvantageous in particular because of the comparatively poor utilization of space in stacking, but is generally put up with because the cylindrical form results in higher stability. Nevertheless, the compressive strength in particular is unsatisfactory, so that the surrounding packaging must be unnecessarily over-dimensioned. This applies in particular to the known cylindrical canisters of plastic, which are much used because of the ease with which they can be manufactured. Such plastics canisters are generally provided with a flanged-on sheet-metal cover. In order to be able to pour out and empty the contents of these canisters cleanly, in particular when pouring mineral oil into the oil filler of a motor vehicle engine, a tool is required, in particular in the form of a punch or spike with a sheet-metal pouring spout pivoted thereto. This method is generally regarded as troublesome and costly.

Furthermore, so-called combination or composite canisters consisting of strong oil-coated paperboard and flanged-on sheet-metal covers are known. This packing is regarded as antiquated and uneconomic, although its strength is adequate. The described difficulties arising at the time of pouring are also present in these canisters.

Moreover, it has been found that difficulties occur in connection with the transport of such circular cylindrical cans or canisters in rather large units of quantity. Firstly, these cans or canisters have poor stackability, so that when a plurality thereof are assembled to form a rather large group or bundle precautions must be taken in order that the bundle may not collape in view of the shocks usually occurring during transport. Generally, therefore, the bundles are tied together with retaining bands or straps. These facilities, however, constitute an additional expense. Added to this is the fact that these arrangements for holding the bundles together have not proved to be adequate on the occurrence of rather large horizontal forces, for example the braking forces of goods wagons or motor lorries.

Secondly, it has been found that in the transport of stacks of containers consisting of circular cylindrical cans or canisters the thrust forces occurring, in particular braking and acceleration forces, cannot be curbed adequately, without supplementary facilites, without damage ocurring to the cans or canisters. In particular during the shunting of goods wagons, the stacks of containers are partly exposed to such high pressures that some containers are destroyed and their contents escape. For the transport of such stacks of containers in goods wagons, inflatable partitions have therefore been provided between the individual stacks so as to enable the forces occurring to be better absorbed. The provision of partitions of this kind constitutes an additional expense. Added to this is the fact that the poor utilization of space already achieved in any case with circular cylindrical containers is worsened still more. It has moreover been found that the protective measures taken by means of partitions are not sufficient in every case.

SUMMARY OF THE INVENTION

The invention aims to solve the problem of providing a container for packaging liquids and also other media which can be manufactured in simple manner at low cost and be handled easily and with which the above disadvantages can be avoided and which, in particular, renders possible better utilization of space in stacking and storage, has better stacking possibilities, so that supplementary reinforcements for holding bundles together can be dispensed with, and can be put together in bundles or groups which have adequate stability and strength in response to any forces occurring.

According to the invention, this problem is solved by means of a container of the kind indicated at the beginning which is characterised in that it has the form of a preferably right prism with two polygonal bases and is adapted to be placed with at least one of its bases and lateral faces against faces of similarly formed containers to form a rather large group or bundle, and that at least one face placeable in this way is provided with engaging means coming into operation when placed against the associated face and counteracting slipping.

As a result of the arrangement side by side of containers designed in accordance with the invention, a substantially better utilization of space can be achieved than with circular cylindrical cans or canisters, since no unused space between the containers occurs, as is the case with cans. By means of the engaging means provided on the individual container faces and counteracting slipping and which come into engagement with the engaging means provided on corresponding faces of other containers when containers formed in the same way are arranged side by side and/or stacked, outstanding support is obtained for the containers placed together and results in good stability and loading capacity of a bundle composed of a plurality of containers. In this way, the loading capacity of an individual container in the bundle with respect to forces acting thereon from outside, for example because of the weight of other container stacked on top, is increased. In view of the prismatic form provided according to the invention, it is moreover always possible to find shapes with which a larger number of containers can be put together without any gaps to form a rather large bundle or simple geometrical configuration, for example a parallelepiped or a cube. In this way there are obtained in combination the advantage of good utilization of space and high resistance to loads due to the weights of the containers filled with the media and also against loads acting from outside on the whole bundle. As a result, considerably larger quantitites of liquid packed in individual packs can be stored and dispatched in a given space.

Owing to the substantially better stacking possibilities and the consequent higher stability of the bundles composed of the containers according to the invention, costly expedients for holding the bundles together are no longer necessary, since these bundles are self-supporting on all sides. Generally, a light wrapping, in particular of shrunk-on film is sufficient.

The bundles composed of containers according to the invention are excellently transportable, since the thrust forces occurring are absorbed by the engaging means arranged on the faces disposed parallel to the direction in which the forces act, so that the container walls are substantially not subjected to bending stresses. The like applies to the vertical forces occurring. Destruction of the containers during transport can be substantially avoided as a result of the design according to the invention without additional expenditure, such as for inflatable partitions and the like, being required.

Manufacture of the containers according to the invention is possible in very simple manner because of their prismatic form. Thus, in particular the side walls can be developed from a web of plastics film, sheet metal or similar material and be combined, more particularly by heat-sealing or welding, with other correspondingly rimmed pieces of material forming the bases or basal surfaces. Particularly simple manufacture is also possible, however, by known processes of plastics forming, combined processes, such as extrusion/blowing and injection moulding/blowing, being suitable in particular. Because of the special stability of the container according to the invention, especially by reason of the stabilizing action of the faces provided with the engaging means during storage and transport, it is possible to manage with comparatively small thicknesses of material in manufacture.

The engaging means preferably oppose any shifting of the containers placed one against the other in all directions parallel to the face placeable in this way. In this way, storage and stacking of the containers on any desired basal or lateral faces is rendered possible, since the effect of this immovability is maintained with all forms of storage. Of course, the bond or connection between the containers assembled to form a bundle is improved, since the engaging means are suitable for absorbing forces occurring in all directions parallel to the face adapted to be placed against another face.

However, it is also possible to provide a constructional form in which the engaging means are operative only in one direction. The design of the engaging means may be varied according to the value and direction of the acting forces and the number and direction of the container faces provided with engaging means. With the engaging means operative only in one direction, there may be advantages in certain circumstances for the taking apart of rather large bundles consisting of a plurality of containers.

The engaging means are advantageously in the form of mutually interlocking teeth. The teeth are preferably provided by projecting and recessed face zones. However, it is also quite possible for the engaging means to comprise at least one friction-increasing surface portion. A friction-causing surface portion of this kind may, for example, consist simply of an applied coating of a non-hardening adhesive. In general, it has been found, however, that in particular where the forces occurring are rather large the engaging means in the form of teeth are superior as regards stability and strength of the bundles and the individual containers.

Three preferred constructional forms of the containers according to the invention with which particularly favourable results can be obtained will be considered hereinafter. These constructional forms, however, do not in any way constitute a limitation. Other forms of container are also quite conceivable.

For example, in one preferred constructional form of the container, the bases are rectangles of equal size. At the same time, its two smaller opposite lateral faces are preferably formed as the standing surface of the container and as the top thereof used for filling and emptying. Depending on the required stability and strength of the bundles, engaging means may be provided on the most diverse faces, the best results being generally obtained when all the face of the container are equipped with engaging means, preferably teeth. It is frequently sufficient, however, if at least two, or preferably all, of the lateral faces are provided with engaging means. The smaller lateral face of the container formed as the top used for filling and emptying renders efficient handling possible.

According to another constructional form, the bases of the container are right-angled parallel triangles of equal size, so that two containers of like form can be put together by means of their inclined lateral faces to form a parallelepiped. This form of container, like that described hereinbefore, is also distinguished by special geometrical simplicity. An inclined lateral face provided with engaging means, in particular teeth or serrations, offers the particular advantage that the weight of the container lying on top increases the interlocking action. Due to the dead weight of the container lying on top and the weight forces of further containers in the stack which are arranged on top of these containers a particularly good mutual interlocking of the lateral faces lying one against the other is obtained, which results in a special stability of bundles composed of such containers, so that frequently no mechanical or manual operations are necessary for holding the bundles together.

Such containers may be provided with a pouring opening arranged on one of the bases in the angle formed between the two larger lateral faces.

It is particularly advantageous, however, if the bases are equal-sized right-angled parallel trapeziums, so that two containers of like form can be put together by means of their inclined lateral faces to form a parallelepiped. The trapeziform shape of the bases offers the special advantage that, as a further development of the invention, the opposite lateral faces adjoining the inclined lateral face can be formed as the standing surface of the container and as the top thereof used for filling and emptying, the larger lateral face providing the standing surface. The advantage of this conformation resides above all in that the narrow top facilitates the pouring out of the liquid after a pouring opening has been made therein, and also in that when the conventional rolled-in tops are employed the loss in capacity due to the rolling-in is only slight.

The advantages of the inclined lateral face mentioned in connection with the above-described constructional form also apply to this constructional form with the trapeziform bases.

According to a special constructional form of a container constructed in this way, its inclined lateral face is provided with step-like shoulders. This constructional form is distinguished by special simplicity of the engaging means on the inclined lateral face, but in this case there is movability in a direction normal to the bases.

According to a specially preferred constructional form of the container according to the invention the said projecting and recessed face zones are arranged on its inclined lateral face, preferably in such manner that a recessed zone of the same area is associated with each projecting face zone in mirror symmetry with respect to an axis of symmetry bisecting the lateral face normally to the bases, and conversely. In this way, by simple measures of manufacturing technique, satisfactory interlocking is obtained between the two lateral faces lying one against the other in all directions parallel to the faces. It proves to be particularly advantageous with this constructional form that it is only necessary to create a single type of container which can be put together with a container formed in the same way to form a parallelepipedal structure.

The projecting and recessed face zones may have the most diverse forms, simple forms such as squares, triangles or circles being naturally preferred for reasons of manufacturing technique. For example, the inclined lateral face of a container may be provided with a square or circles arranged centrally in the face and which may constitute a projecting and a recessed zone of halves separated by the axis of symmetry bisecting the face and extending normally with respect to the bases of the container. Naturally, the inclined side wall of the container may also be provided with a plurality of projecting and recessed zones, as long as there is always a counter-element arranged symmetrically with respect thereto in the face. These teeth or interlocking portions represent an excellent engaging means between the inclined lateral faces resting one against the other in containers which have been assembled together, which engaging means prevents any shifting of the containers with respect to one another in any direction parallel to the inclined lateral faces by forces acting thereon. At the same time, however, these teeth render possible a satisfactory separation of assembled containers in a direction normal to the inclined lateral faces.

The inclined lateral face of a container is advantageously divided into four rectangular zones of equal area, of which those adjacent to one another form in each case a projecting and a recessed zone. According to this constructional form, there is a projecting and a recessed face zone above and below the axis of symmetry bisecting the inclined lateral face and extending normally with respect to the base. This chessboard-like division of the inclined lateral face is simple to execute from the point of view of manufacturing technique and ensures secure interlocking even with only slightly projecting and recessed face zones, because the entire area of the inclined lateral face is in the form of interlocking elements.

In another constructional form of the container according to the invention, a non-projecting and non-recessed strip extending normal to the base is arranged between the four projecting and recessed face zones. In this way, a step-like graduation of the projecting zone towards the recessed zone is obtained. Depending on the desired interlocking action, the strip may be widened or narrowed accordingly. According to another constructional form, a strip of this kind extending parallel to the bases may be arranged between the four zones. This constructional form is preferred to a lesser extent, however, since the area available for the projecting and recessed zones is comparatively small.

The division chosen for the inclined lateral face is also advantageously provided in the lateral face opposite thereto. It is clear that the bases and the other lateral faces may also be equipped with any teeth or interlocking portions in order to achieve the multi-face interlocking action described hereinafter.

BRIEF DESCRIPTION OF THE DRAWINGS

The invention will now be further described, by way of example, with reference to the accompanying drawings, in which.

DESCRIPTION OF PREFERRED EMBODIMENTS

Figure 1:
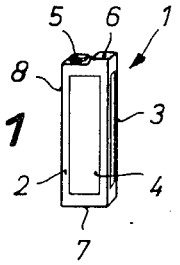
FIG. 1 is a diagrammatic perspective view of a container designed in accordance with the invention and having rectangular bases, suitable interlocking means being omitted.

There is shown in FIG. 1 a container 1 designed in accordance with the invention and having two rectangular bases 2. The container may have suitable engaging means, for example teeth or a friction-increasing surface portion, on its respective defining faces, a friction-increasing surface portion 4 being simply indicated in FIG. 1. The parallelepipedal container has four lateral faces 3, 8, 6 and 7, of which the two smaller faces 6 and 7 are formed as the standing surface 7 of the container and as the top 6 thereof used for filling and emptying. The top 6 is provided with a suitable filling and emptying opening 5. The geometrical shape shown here can be handled in a particularly favourable manner. .

Figure 2:
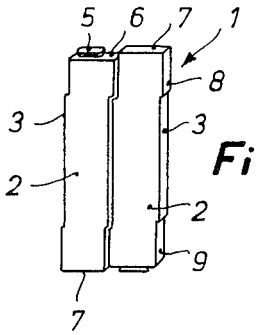
FIG. 2 is a diagrammatic perspective view of two containers according to FIG. 1 assembled together and in which interlocking means are indicated diagrammatically.

FIG. 2 shows two containers according to FIG. 1 assembled together to form a bundle and in which the larger lateral faces 3 and 8 are now, however, equipped with projecting and recessed areas 8 and 9 which serve as mutually engaging teeth or interlocking means. Of course, the basal and other lateral faces may also be provided with such interlocking means, which is not, however, shown here. In the constructional form shown here, one container is turned through 180° with respect to the other before it is assembled together with the latter container. Because of this method of assembling the containers together, they can all be formed alike, so that variations do not need to be made in the interlocking elements.

Figure 3:
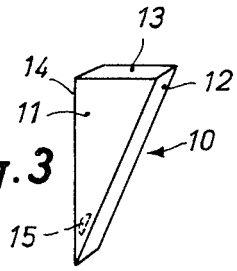
FIG. 3 is a diagrammmatic perspective view of a container designed in accordance with the invention and having triangular bases and no teeth or interlocking means.

FIG. 3 shows a container 10 designed in accordance with the invention and having two triangular bases 11, one inclined lateral face 12 and one larger straight lateral face 14 and one smaller straight lateral face 13. The smaller lateral face 13 may serve as the standing surface of the container. A pouring opening 15 is provided in one base 11 in the angle formed by the two longer lateral faces. For simplicity, the container is shown without engaging means, which will be described in detail in connection with the following drawings.

Figure 4:
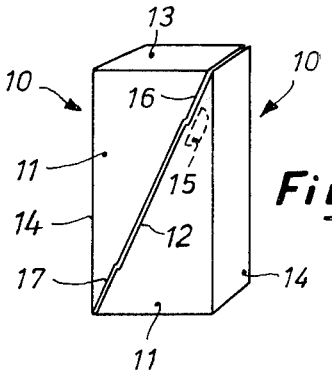
FIG. 4 is a diagrammatic perspective view of two containers according to FIG. 3 assembled together and whose inclined lateral faces are equipped with teeth.

FIG. 4 shows two of the containers 10 illustrated in FIG. 3, which are placed one against the other by means of their inclined lateral faces 12. The inclined lateral faces 12 are provided with projecting elements 16 and recessed elements 17, which form mutually engaging or interlocking teeth. Two containers can be put together every time to form a parallelepipedal structure, so that good utilization of space and good stacking possibilities are provided.

Figure 5:
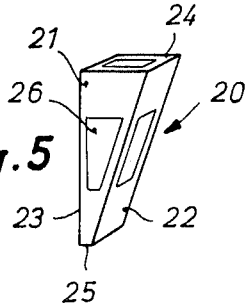
FIG. 5 is a diagrammatic perspective view of another constructional form of the container according to the invention with trapeziform bases and whose faces are provided with friction-increasing surface portions.

FIG. 5 shows another constructional form of a container according to the invention 20, which has two trapeziform bases 21, one inclined lateral face 22, one larger straight lateral face 23 and two smaller opposite straight lateral faces 24 and 25, of which last-mentioned faces, on the other hand, the larger 24 is formed as the standing surface of the container and the smaller 25 as the top thereof used for filling and emptying. The individual defining faces are furnished with friction-increasing surface portions 26.

Figure 6:
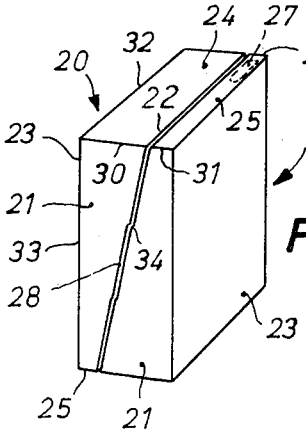
FIG. 6 is a diagrammatic perspective view of two containers according to FIG. 5 assembled together and whose inclined lateral faces are stepped form.

In conjunction with FIG. 6, there will now be given a detailed description of this preferred constructional form which is shown in FIGS. 8 to 11 in further developed form. Each of the two containers 20 consists of two trapeziform bases 21 arranged parallel to each other at a mutual distance apart and connected by lateral faces, 22, 23, 24 and 25 to form a hollow body closed upon itself. Since the bases 21 are right-angled parallel trapeziums of equal size, on the illustrated combination of two containers there is obtained a parallelepipedal bundle in which the two containers lie one against the other at their inclined lateral faces 22. The opposite lateral faces 24 and 25 adjoining the inclined lateral face are formed as the top thereof used for filling and emptying, the larger lateral face 24 providing the standing surface. The lateral face 25 forming the top is preferably connected to the other parts of the container by means of a rolled-in rim 29, it being also possible to produce the lateral face forming the top of the container from a different material to the other parts of the container. This is particularly advantageous in the event of the container being produced from plastics by a blowing process, when a mouth is first formed instead of the lateral face 25 by a bursting process. This mouth can then be closed by means of a rolled-in sheet-metal cover. It is also possible, however, to choose other constructions, a particularly simple possibility consisting in that a liquid-tight seal is produced by means of a plastic-coated aluminium foil. Another possibility consists in that the lateral face 25 forming the top of the container is first formed completely or at least partially (in particular in the form of a plurality of marginal or rim portions) together with the other parts of the container in a single operation and a smaller filling opening is then provided in this face and furnished with a closure, for example again in the form of a seal produced by means of a plastic-coated metal foil or with the aid of a flanged sheet-metal cap. In FIG. 6 there is provided a press-in portion 27 shown at the narrow side of the lateral face 25 forming the top of the container which press-in portion can easily be pushed in with a finger to empty the container. By reason of the narrow shape of the top, no special aid such as a funnel or the like is necessary for accurate pouring. This particularly simple possibility of emptying represents a very special advantage of the container.

The bases 21 and the lateral face 23 located at right angles therebetween offer a large amount of room for applying inscriptions, illustrations and the like, the plane form of these face facilitating the applicatiom of directions of this kind. In particular, both labels and printed matter, produced especially by flat screen printing, can easily be applied. In comparison with cylindrical containers, the area available for directions is considerably larger.

The container shown in FIG. 6 may suitably have, more particularly for a capacity of about 1 litre, the following dimensions;

Length of the edge 30 about 9.3 cm
Length of the edge 31 about 1.2 cm
Length of the edge 32 (distance between the bases) about 10.3 cm
Length of the edge 33 about 20.4 cm.

With these dimensions, the bundle consisting of two containers which is shown in FIG. 6 has a capacity of about two litres. A cylindrical container accommodated in the same space, on the other hand, would have of necessity a capacity of 1.6 litres at the most. This means a considerable improvement in economy as regards storage and distribution. Moreover, with cylindrical containers, the mutual support possible on all sides with the containers described here, as well as the stiffening effect of the obliquely extending faces 22, are not possible; in the case of cylindrical containers, mutual support can naturally only take place along a line of contact at the cylindrical surfaces, which is particularly unfavourable for their resistance, and through the end faces.

In the constructional form shown in FIG. 6, the inclined lateral faces 22 of the containers are provided with step-like shoulders 28; in reality, this is therefore a question of a plurality of inclined faces offset with respect to one another by these step-like shoulders. With the suitable dimensions indicated above, the width of the steps 34 may be about 3 to 4 mm.

Figure 7:
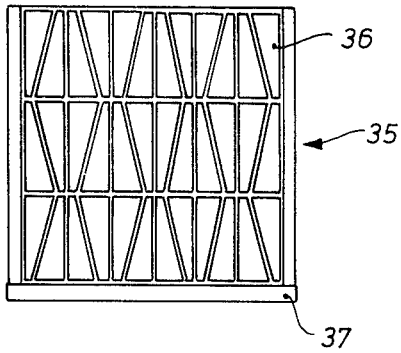
FIG. 7 is a diagrammatic side view of a stack of the containers shown in FIGS. 5 and 6.

FIG. 7 shows a stack 35 of assembled containers 36 according to FIG. 6 on a supporting pallet 37. It is naturally readily possible to adapt the dimensions of the containers to any desired size of pallet in such manner that the room available on the pallet is fully utilized. In particular, it is readily possible to adapt the dimensions to the largely conventional industrial pallet having the dimensions 1000 × 1200 mm, and also to the so-called Europe pallet having the dimensions 800 × 1200 mm.

Containers shown in FIGS. 5 to 7 further developed in accordance with the invention are illustrated in FIGS. 8 to 11. In describing them, reference is therefore made essentially only to the further development according to the invention while attention is drawn to the description of FIGS. 5 to 7 for the fundamental features.

Figure 8:
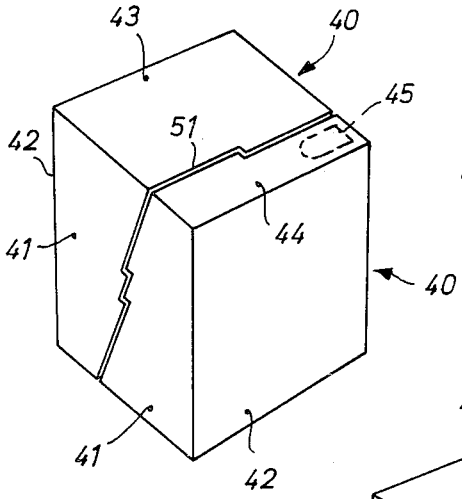
FIG. 8 is a diagrammatic perspective view of two containers placed together and having trapeziform bases.

FIG. 8 shows two containers 40 with trapeziform bases 41 which are connected by the lateral faces 42, 43, 44 and 51 to form a hollow body closed upon itself. The containers are placed one against the other by means of their inclined lateral faces 51, so that a parallelepipedal structure is created.

Figure 9:
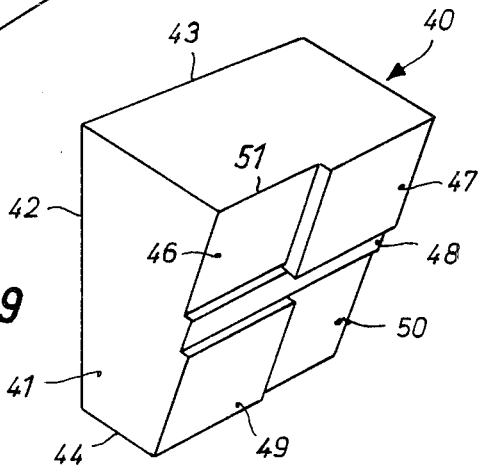
FIG. 9 is a diagrammatic perspective view of one of the containers shown in FIG. 8.

For better illustration of the inclined lateral faces 51 formed in accordance with the invention, the container 40 is shown in a separate position in FIG. 9. The inclined lateral face 51 is composed of two projecting face areas 47 and 49, two recessed face areas 46 and 50 and a strip 48 extending on the axis of symmetry bisecting the inclined lateral face normal to the bases, the said strip being located in the plane of the original lateral face and neither projecting nor being recessed.

Chessboard-like areas or panels are formed by the projecting areas 47 and 49 and the recessed areas 46 and 50, projecting and recessed areas being diagonally opposite each other in each case. Shifting of the containers with respect to each other or slipping thereof on one another is thereby prevented in all directions parallel to the inclined lateral face.

The strip 48 extending in a horizontal direction serves in particular to graduate the projecting areas 47 and 49 with respect to the recessed areas 46 and 50, so as to prevent shearing of the areas 47 and 49 when the forces to be absorbed are large. The strip 48 may naturally also be dispensed with, so that the inclined lateral face 51 is only divided into four areas, or another strip extending in a vertical direction may be provided, so that two strips intersect at right angles.

It is clear that all the types of containers shown in the drawings so far may be furnished with suitable engaging means on any desired faces. Even if this has not been expressly referred to, suitable pouring openings, designated for example in FIG. 8 by the reference 45, can be provided.

Figure 10:
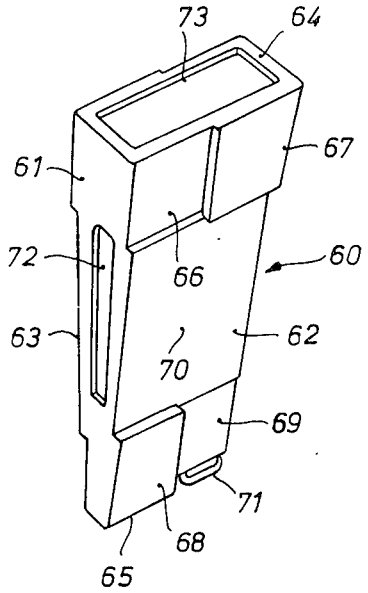
FIG. 10 is a diagrammatic perspective view of another constructional form of the container according to the invention having trapeziform bases.
Figure 11:
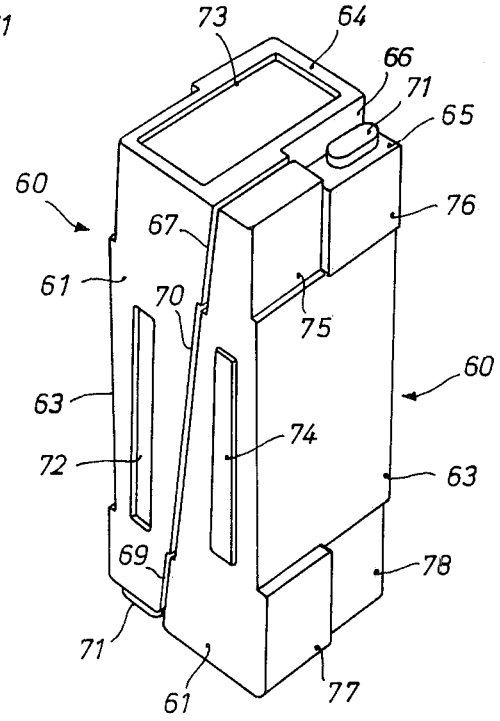
FIG. 11 is a diagrammatic perspective view of two containers according to FIG. 10 assembled together.

FIGS. 10 and 11 show a specially preferred constructional form of the container according to the invention, this being illustrated in a separate position in FIG. 10. The container 60 has two trapeziform bases 61 and lateral faces 62, 63, 64 and 65 which form a closed hollow body. A suitable pouring opening 71 is provided on the smallest lateral face 65 serving as the top. In the type of container shown here, the strip 48, shown in FIG. 9 is widened into a strip 70, so that the projecting face areas 65 and 67 and the recessed areas 66 and 69 have reduced dimensions. Basically, the dimensions of the face areas forming the teeth or interlocking means can be chosen in accordance with aspects of manufacturing technique, from the point of view of handling and according to the loads occurring.

The base 61 which can be seen in FIG. 10 likewise has a recessed area 72 serving as an interlocking means. It is clear that the opposite base has a projecting area formed with an equal area. The lateral face 64 serving as the standing surface is likewise provided with a recessed area 73. The lateral face 65 serving as the top is so designed that the pouring opening 71 does not project beyond the top. This is achieved in that the top is stepped down in step fashion and the pouring opening 71 is located on the lower step of the top, the top edge of the pouring opening being in line with the level of the higher step.

Two of the containers 60 shown in FIG. 10 can be seen in FIG. 11 in the assembled state. It becomes clear from FIG. 11 that the lateral face opposite the inclined lateral face 62 is also provided, in a similar manner to this face, with projecting face areas 75 and 78 between which a non-projecting and non-recessed strip extends.

As already stated at the beginning, containers consisting of plastics are particularly easy to manufacture and have favourable properties in use. Particularly suitable are plastics of the polyolefin group, in particular polyethylene and polypropylene. The mounding or shaping may be effected by conventional processes of plastics processing, extrusion or injection moulding steps combined with blowing moulding steps being particularly suitable. In particular, by optimum control of the wall thickness during the extrusion and/or during the blowing process, the wall thickness distribution can be so chosen in each case that as favourable a compromise as possible between strength and the weight of material used is obtained. Precisely as regards the consumption of material the container according to the invention offers advantages, since it has a particularly good compressive strength which is further increased by the mutual support provided when a plurality of containers are placed together to form rather large groups or bundles.

The length and size conditions which can be gathered from the drawings and the above-indicated numerical date are naturally not compulsory, but can be varied according to the circumstances obtaining, in particular as regards the machines employed for manufacture.

Other constructional forms are possible without departing from the scope of the invention as defined in the claims.

What is claimed is:

1. A container for packaging liquids adapted to interengage with an identical container to define a right parallelpiped form whereby interengaged containers interlock to restrict relative displacement therebetween comprising a hollow body having first and second spaced parallel sides of right angle trapezoid form, first and second nonparallel lateral sides, and parallel upper and lower sides, said first lateral side being perpendicular to said lower side, the spacing between said lateral sides being greater adjacent said lower side than at said upper side, first engaging means defined on said second lateral side adjacent said upper side, second engaging means defined on said second lateral side adjacent said lower side, said engaging means including surfaces transversely disposed to said second lateral side and of complimentary mating configuration, third engaging means defined on said first parallel side of trapezoid form, and fourth engaging means defined on said second parallel side of trapezoid form, said third and fourth engaging means being complimentary and interengageable for engagement with adjacent like containers.

2. In a container for packaging liquids as in claim 1 wherein said first engaging means comprises a recess and said second engaging means comprises a projection complimentary to said recess.

3. In a container for packaging liquids as in claim 1 wherein said third engaging means comprises a rectangular recess and said fourth engaging means comprises a complimentary rectangular projection.

4. In a container for packaging liquids as in claim 1 wherein said first and second engaging means each comprise a projection and a recess of complimentary mating configuration.

5. In a container for packaging liquids as in claim 4 wherein said projections and recesses are each defined by surfaces substantially parallel to said lateral sides and said upper and lower sides.

6. In a container for packaging liquids as in claim 5 wherein said projections and recesses are defined upon both said first and second lateral sides adjacent said upper and lower sides.

* * * * *